US011946212B2

(12) United States Patent
Stone

(10) Patent No.: US 11,946,212 B2
(45) Date of Patent: Apr. 2, 2024

(54) VEHICLE SECURITY BARRIER AND SYSTEM FOR HOSTILE VEHICLE MITIGATION

(71) Applicant: Mark Stone, Ashbourne (GB)

(72) Inventor: Mark Stone, Ashbourne (GB)

( * ) Notice: Subject to any disclaimer, the term of this patent is extended or adjusted under 35 U.S.C. 154(b) by 287 days.

(21) Appl. No.: 17/285,979

(22) PCT Filed: Oct. 17, 2019

(86) PCT No.: PCT/GB2019/052972
§ 371 (c)(1),
(2) Date: Apr. 16, 2021

(87) PCT Pub. No.: WO2020/079442
PCT Pub. Date: Apr. 23, 2020

(65) Prior Publication Data

US 2021/0381180 A1 Dec. 9, 2021

(30) Foreign Application Priority Data

Oct. 17, 2018 (GB) ..... 1816944

(51) Int. Cl.
*E01F 15/04* (2006.01)
*E01F 13/12* (2006.01)

(52) U.S. Cl.
CPC ..... *E01F 13/12* (2013.01); *E01F 15/04* (2013.01); *E01F 15/0484* (2013.01)

(58) Field of Classification Search
None
See application file for complete search history.

(56) References Cited

U.S. PATENT DOCUMENTS 466,315 A * 1/1892 Babcock ..... E04H 12/08 52/153
1,788,501 A * 1/1931 Williams ..... E01F 15/06 248/66
2,227,553 A * 1/1941 Paque ..... E04H 17/06 52/153
2,677,530 A * 5/1954 Lauffenburger ..... E01F 15/06 256/13.1
7,325,788 B1 * 2/2008 Stanek ..... E01F 15/0461 256/65.14

(Continued)

FOREIGN PATENT DOCUMENTS

CH 687 401 11/1996
CN 203 795 341 8/2014

(Continued)

OTHER PUBLICATIONS

International Searching Authority: International Search Report and Written Opinion, App. No. PCT/GB2019/052972 (dated Jan. 9, 2020).

(Continued)

*Primary Examiner* — Thomas B Will
*Assistant Examiner* — Katherine J Chu
(74) *Attorney, Agent, or Firm* — Walters & Wasylyna LLC

(57) ABSTRACT

Aspects of the invention relate to a vehicle security barrier system for hostile vehicle mitigation. The vehicle security barrier system comprising: a panel; first and second support members; and a reinforcing arrangement.

16 Claims, 9 Drawing Sheets

(56) References Cited

U.S. PATENT DOCUMENTS

| | | | | |
|---|---|---|---|---|
| 8,757,597 | B2 * | 6/2014 | James | E01F 15/06 404/6 |
| 9,428,872 | B2 * | 8/2016 | Neusch | E01F 13/12 |
| 10,947,754 | B2 * | 3/2021 | Sorkin | F16G 11/048 |
| 2011/0062403 | A1 | 3/2011 | Neusch | |
| 2016/0376759 | A1 * | 12/2016 | Gerrard | E04H 17/22 256/13.1 |
| 2021/0115635 | A1 * | 4/2021 | Delot | E01F 15/06 |
| 2022/0228331 | A1 * | 7/2022 | Hudson | E01F 15/06 |

FOREIGN PATENT DOCUMENTS

| | | | | | |
|---|---|---|---|---|---|
| CN | 204 238 149 | | | 4/2015 | |
| CN | 104 894 998 | | | 3/2017 | |
| EP | 0258585 | A2 | * | 3/1988 | |
| FR | 1382258 | A | * | 12/1964 | |
| FR | 1400144 | A | * | 5/1965 | |
| GB | 2433285 | A | * | 6/2007 | E01F 15/025 |
| KR | 2008-0104647 | | | 12/2008 | |
| KR | 20090105123 | A | * | 10/2009 | |
| KR | 20100090014 | A | * | 8/2010 | |
| KR | 10-1095059 | | | 12/2011 | |
| KR | 101374392 | B1 | * | 3/2014 | |
| KR | 101489448 | B1 | * | 2/2015 | |

OTHER PUBLICATIONS

Intellectual Property Office: Combined Search and Examination Report, App. No. GB1816944.4 (dated Mar. 29, 2019).

* cited by examiner

VEHICLE SECURITY BARRIER AND SYSTEM FOR HOSTILE VEHICLE MITIGATION

This application is the U.S. national phase entry of Intl. App. No. PCT/GB2019/052972 filed on Oct. 17, 2019, which claims priority from GB1816944.1 filed on Oct. 17, 2018. The entire contents of Intl. App. No. PCT/ GB2019/052972, GB1816944.1 are incorporated herein by reference.

FIELD OF THE INVENTION

The present invention relates to a vehicle security barrier and system for hostile vehicle mitigation which protects pedestrians (and other pavement users) from potential vehicle impact, and to one or more components thereof. More particularly, but not exclusively, the present invention relates to vehicle security barrier system that utilises "clear view" type guard rails and to an improvement or modification of such guard rails to provide pavement users with a greater degree of protection, against a vehicle mounting the walkway or pavement. The invention finds advantageous application in locations where a local council, or other appropriate or local authority has provided permission for installation of an existing-type of pedestrian guard rail, often referred to as "clear-view" railings (the name "clear-view" is used because the open structure, does not, for the most part, significantly inhibit a pedestrian's view of the road and traffic travelling along the road.

Aspects of the invention relate to an installed vehicle security barrier system, to a vehicle security barrier unit, to a reinforcing arrangement for installation in a vehicle security barrier system and to a method of reinforcing an installed vehicle security barrier system.

BACKGROUND OF THE INVENTION

Guard rails are a common pedestrian safety feature. It is known to provide guard rails or pedestrian safety railings, particularly in urban areas, to safeguard pedestrians and pathway users. Typically, such guard rails are used outside schools, along high streets, along central reservations and in similar suitable places and are provided to stop pedestrians from crossing roads in dangerous places. The guard rails are also useful at stopping groups or crowds of people in busy places from accidentally spilling over into a road, for example, outside schools and sports stadiums. Such guard rails, may have a generally rectangular section, two supporting upright legs for each generally rectangular section, one or more cross-members, and optionally a visibility gap at the top of the barrier. The barriers may be made from galvanised steel and may be powder coated. Such barriers or guard rails are also known as "clear view pedestrian guard rails", and are often installed in sections comprising two, three or more guide rail panels, affixed together and concreted into the ground.

The installation of such road-side guard rails is typically controlled and maintained by local councils or local authorities and these entities are usually also responsible for maintaining them. The barriers themselves may need to comply with certain standards, for example, a concrete foundation for each leg of a barrier may need to comply with British Standards. Permission for installation of a barrier in a public location is strictly controlled by local authorities who need to consider safety and the aesthetic impact on the local area.

The British Standards Institute (BSI) has established a British standard BS7818:1995 which specifies the requirements for pedestrian and other non-vehicular user restraint systems in metal for use on roads and highways. This BSI standard dates back to 1995 and is a standard for pedestrian barriers which are intended to control or guide the flow of people. In more recent times, it has become of greater necessity to safeguard against vehicles being used as weapons. Accordingly, there are a number of standards that relate to vehicle security barriers (VSBs), the purpose of which are to stop a vehicle or at least resist a vehicle impact. For example, the International Organization for Standardization (ISO) has established an International Workshop Agreement IWA 14-1:2013 which specifies the essential impact performance for a vehicle security barrier and a test method for rating its performance when subjected to a single impact by a test vehicle not driven by a human being.

Accordingly, it will be recognised that there is a significant difference between a pedestrian guide rail on the one hand and a vehicle security barrier on the other. A pedestrian guide rail is suitable for providing a degree of separation between vehicular road traffic and pedestrians and is useful in preventing pedestrians, particularly young children, from straying off into dangerous or off-limits areas. One such example is the installation of guiderails near school gates where the children spill out of school onto pavements. The barriers typically prevent the children from spilling over onto the road. These barriers are unlikely to provide much, if any protection in the event a vehicle collided into the barrier. Existing pedestrian guide rail barriers are not intended to withstanding a deliberate, targeted and malicious impact from a vehicle bome attack. In contrast, their purpose is to inhibit pavement users from stepping out into the road and to encourage pavement users to follow a safer route or find a safer location for crossing a road.

The present invention however, seeks to provide an improvement in the field of vehicle security barriers that has particular benefit for pedestrian safety in situations where an existing pedestrian safety guardrail exists and where it may in fact be more beneficial to have a robust vehicle impact security barrier to provide greater protection for pedestrians and pavement users.

Aspects and components of the inventive vehicle security barrier system and reinforcing arrangements taught herein may be utilised in other applications to provide reinforcements of a variety of barriers and fences; retro-fitted; installed as a completely new fitment; and/or used in applications other than for pedestrian barrier solutions. For example, where it is required to provide a barrier to protect against a vehicle deliberately and maliciously trying to impact a shop, house, school, or other building.

SUMMARY OF THE INVENTION

According to one aspect of the invention, for which protection is sought, there is provided a security barrier system for hostile vehicle mitigation, the vehicle security barrier system comprising:

a panel;

first and second support members; and a reinforcing arrangement, the panel comprising:

i) first and second transverse rail members, each having first and second ends, the first and second transverse rail members extending between the first and second support members; and ii) a third rail member extending between the first and second transverse rail members;

the reinforcing arrangement comprising:

i) a first cable extending through the first transverse rail member, the first cable having first and second attachment components at each of first and second ends thereof, the first attachment component being coupled to the first support member, and the second attachment component being coupled to the second support member;

ii) a second cable extending through the second transverse rail member, the second cable having first and second attachment components at each of first and second ends thereof, the first attachment component of the second cable being coupled to the first support member, and the second attachment component of the second cable being coupled to the second support member; and i) a third cable extending within the third rail member, the third cable having first and second attachment components at each of first and second ends thereof, the first attachment component of the third cable being coupled to the first cable extending within the first transverse rail member, and the second attachment component of the third cable being coupled to the second cable extending through the second transverse rail member.

Optionally, the first and second transverse rail members are disposed in a parallel manner to one another and in a perpendicular orientation relative to the first and second support members.

Optionally, the third rail member extends vertically between the first and second transverse rail members.

Optionally, the panel further comprises:

iv) a fourth transverse rail member, having first and second ends, the fourth transverse rail member extending between the first and second support members and being adjoined at its first and second ends to the first and second support members respectively.

Optionally, the reinforcing arrangement further comprises:

iv) a fourth cable extending within the fourth transverse rail member, the fourth cable having first and second attachment components at each of first and second ends thereof, the first attachment component of the fourth cable being coupled to the first support member, and the second attachment component of the fourth cable being coupled to the second support member, the fourth transverse rail member being disposed at an elevation that is above the second transverse rail member and below the first transverse rail member, such that the fourth transverse rail member intersects the third rail member that extends vertically between the first and second transverse rail members, and such that the third cable extending within the third rail member crosses or intersects the fourth cable.

Optionally, the first and second attachment components of the third cable comprise a loop.

Optionally, one or more of the first, second, third and fourth cables comprise a twisted steel cable having a diameter of about 8 mm, about 10 mm or about 20 mm.

Optionally, the first and second attachment components of the first, second, and/or fourth cables comprise an end stop.

Optionally, the first and second posts are provided with a slot and cover.

Optionally, the first and second attachment components of the first, second, and/or fourth cables comprise a loop.

Optionally, the first and second posts are provided with an aperture, two recesses and a cover plate affixed to the posts.

According to a further aspect, there is provided a post for a vehicle security barrier system, the post comprising:

i) a tubular main section;

ii) a heel plate;

iii) a toe plate having a lip edge;

iv) at least two apertures formed in the tubular main section, each for receiving an end of a cable forming part of a reinforcement arrangement;

v) a locking post extending through the main section, the locking post sized and configured for being threaded through an attachment means at an end of a said cable of the reinforcement arrangement;

vi) first and second cover plates positioned over the at least two apertures formed in the main section and attached to the main section and/or to a panel of the vehicle security barrier system; and vii) one or more reinforcing plates affixed to the tubular main section and overlapping one or more portions of at least one of the at least two apertures.

Optionally, the tubular main section has a top cap covering an uppermost end thereof, to which said locking post is affixed.

Optionally, the heel plate is disposed at an elevation below the toe plate, such that in use, the heel plate is disposed below ground level and below the level of the top plate; and where in use, the top plate is also disposed below ground level.

Optionally, a bottom cap covers a bottommost end of the tubular main section.

Optionally, the tubular main section has a generally square cross-sectional shape.

According to yet an even further aspect, there is provided a method of forming a vehicle security barrier system comprising:

first and second support members; and a panel comprising:

i) first and second transverse rail members, each having first and second ends, the first and second transverse rail members extending between the first and second support members and each being adjoined at their first and second ends to a first and a second support member respectively; and ii) a third rail member extending between the first and second transverse rail members;

the method comprising installing a reinforcing arrangement, the reinforcing arrangement comprising: first, second and third cables, each comprising a first attachment component and a second attachment component at each end thereof, wherein said installing the reinforcing arrangement comprises:

i) threading the third cable through the third rail member, such that the first and second attachment components can be coupled to the first cable and to the second cable;

ii) threading the first cable through the first transverse rail member;

iii) coupling the first cable to the first attachment component of the third cable;

iv) affixing the first attachment component of the first cable to the first support member;

v) affixing the second attachment component of the first cable to the second support member;

vi) threading the second cable through the second transverse rail member and coupling the second cable to the second attachment component of the third cable;

vii) affixing the first attachment component of the second cable to the first support member; and viii) affixing the second attachment component of the second cable to the second support member.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments of the invention will now be described, by way of example only, with reference to the accompanying drawings, in which.

DETAILED DESCRIPTION OF EMBODIMENTS

Figure 1:
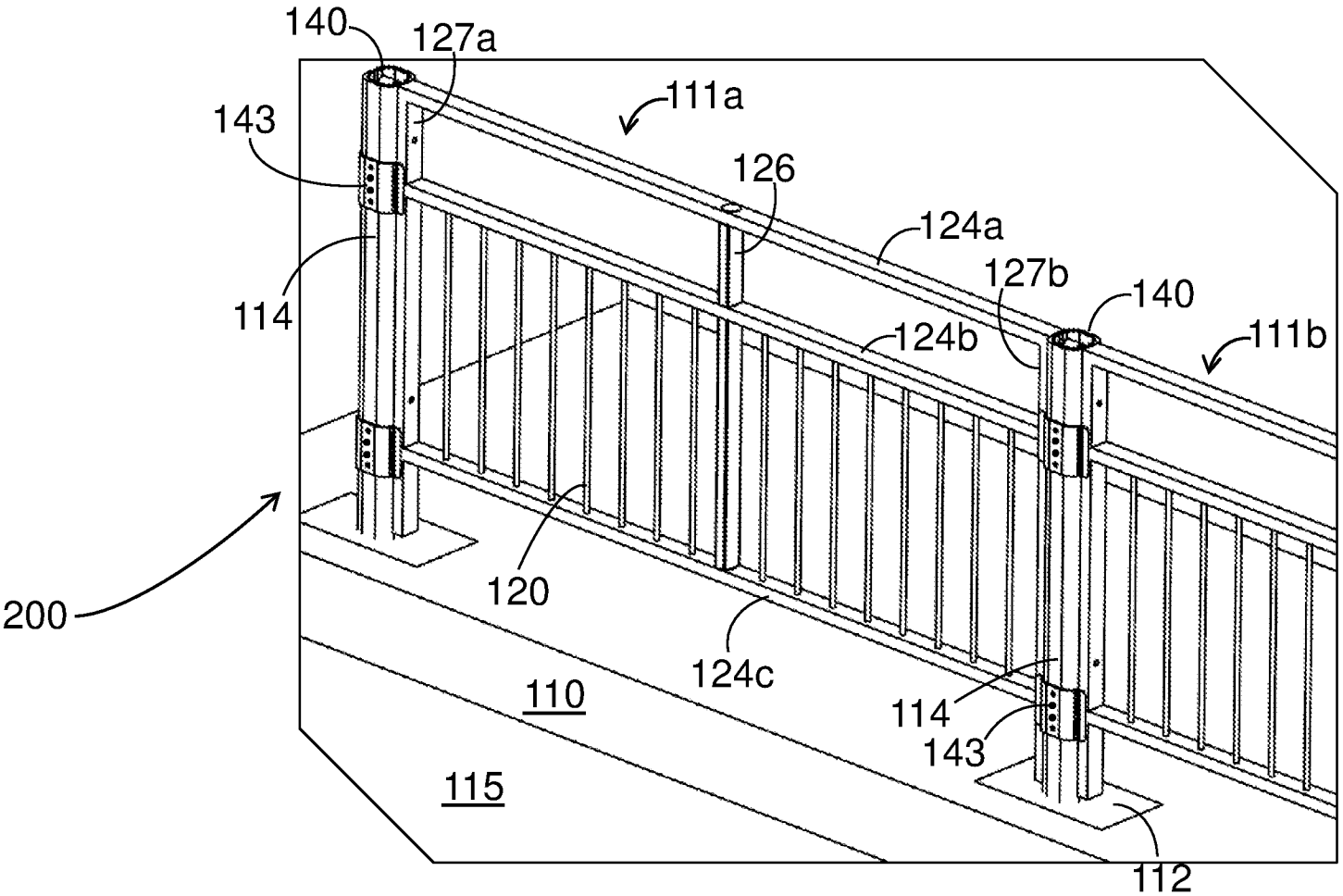
FIG. 1 is a perspective view of a section of a vehicle security barrier system according to an embodiment of the invention, wherein one full vehicle security barrier panel is shown installed on a pedestrian walkway (pavement, side walk or footpath) alongside a kerb (curb) of the pedestrian walkway. The kerb is an edge where a raised pedestrian walkway meets a road.

Detailed descriptions of specific embodiments of the vehicle security barrier systems, vehicle security barrier units, reinforcing arrangements and methods of reinforcing an installed guide rail system to produce a vehicle security barrier system of the present invention are disclosed herein. It will be understood that the disclosed embodiments are merely examples of the way in which certain aspects of the invention can be implemented and do not represent an exhaustive list of all of the ways the invention may be embodied. Indeed, it will be understood that the vehicle security barrier systems, vehicle security barrier units, reinforcing arrangements and methods of reinforcing an installed guide rail system to produce a vehicle security barrier system described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In addressing the serious concern that existing pedestrian guide rail barriers, installed outside schools, playgrounds, and other public areas, are not intended to withstanding a deliberate, targeted and malicious impact from a vehicle borne attack, the applicant has considered a number of aspects. These include, but are not limited to:

- the public, road users and pedestrians a like, are all very familiar with existing styles of guard rail and that a significant change in appearance could cause complaints and objections;
- a highly protective vehicle security barrier that has an appearance significantly different from those in current use, particularly one which looked like an anti-terror attack structure could create a climate of fear, unnecessarily raise panic levels, make people feel nervous and may make them feel less safe;
- planning permission for installation of new barriers may be very difficult to obtain thus increasing cost and timescale involved in the installation and implementation of new style of vehicle security barrier;
- installation needs to be quick to reduce labour costs and to minimise any inconvenience to road and pathway users;
- installation needs to be easy or as simple as possible so that it can be done quickly and yet with high-degree of accuracy;
- in spite of the added quality of being able to withstand a deliberate vehicular attack, the panels must still provide a high degree of visibility for both pedestrians and road-user's alike;
- the cost of a new, more highly protective, vehicle security barrier needs to be as low as possible;
- if maintenance is needed, for example following a "normal" road traffic incident in which a vehicle accidently struck a railing, it is beneficial if a replacement can be easily, quickly and accurately installed;

it would also be desirable if the transportation and delivery cost of the new, highly protective, vehicle security barrier system could be kept as low as possible.

With all of these and other considerations in mind, the applicant has created a method of reinforcing existing-style guard rail panels. The reinforcing arrangements and methods taught herein are not necessarily limited in their use and application to existing-style guard rail panels. Advantageously however, because reinforcing arrangements and methods can be installed in or used with existing style guard rail panels, the appearance is generally similar or unaltered and issues listed above associated with causing complaints and panic, and associated with planning permissions and maintaining visibility are all inherently addressed.

To adequately reinforce existing-type or existing-style guard rail panels it is beneficially, skillfully and uniquely disclosed herein to provide a reinforcing arrangement that comprises at least two horizontal steel wire cables threaded within a guide rail panel that are tethered to one another, at least by means of a vertical steel wire cable. The two horizontal steel wire cables are tethered at each of their ends to an adjacent guide rail panel or supporting post, such that the resulting, improved vehicle security barrier system has the new reinforcing arrangement running or extending entirely through its length. In this way the first and last panels and/or first and last support posts of a vehicle security barrier, along with the panels and posts in between, are connected together by the internal reinforcing arrangement.

It will be understood that a reinforcing arrangement of the present disclosure may be retro-fitted into existing, already installed pedestrian guide rails. It will be appreciated that existing "off-the shelf" guide rail panels can be modified to accommodate the reinforcing arrangement. Furthermore, the present disclosure provides a "smart post" also referred to as "support member", "support post" or "post" herein, which is specifically configured to accommodate the reinforcing arrangement, and as such may also be considered as part of the reinforcing arrangement. It will be understood that a reinforcing arrangement of the present disclosure may be installed in other kinds of panel and is not limited in its application to the panels described and illustrated herein.

Reference is now made to FIG. 1, wherein a section of a vehicle security barrier system 200 is shown. The system is mounted at the edge of a pavement, close to a kerb 110 between the between the pavement and a traffic-bearing road 115. The system 200 is made up of a series of panels 111*a*, 111*b*, held in place at each of their ends by a post 114. As such, for a system 200 comprising three panels 111*a*, 111*b*, four posts 114 are used. The panels 111*a*, 111*b* are optionally each similar in dimension, shape, style and appearance to each other panel 111*a*, 111*b* in the system 200.

Each panel 111*a*, 111*b* comprises a first transverse rail member 124*a* and a second transverse rail member 124*c*. First and second vertical end rails 127*a*, 127*b* may extend vertically between the first and second transverse rail members 124*a*, 124*c* such that the panels 111*a*, 111*b* each have a generally rectangular and tubular main frame. Optionally, the tubular first and second vertical end rails 127*a*, 127*b*; and the tubular first and second transverse rail members 124*a*, 124*c*, each have square cross-sections.

A third rail member 126 extends between the first and second transverse rail members 124*a*, 124*c*, and crosses a fourth transverse rail member 124*b*. The fourth transverse rail member 124*b* extends in-between (i.e. below and above) the first and the second transverse rail members 124*a*, 124*c* respectively.

A reinforcing arrangement is installed into and forms part of the vehicle security barrier system 200. Elements 205 of the reinforcing arrangement include: first, second third and fourth cables 122*a*, 122*c*, 122*d*, 122*b*, each comprising a first attachment component 138*a*, 138*c*, 138*d*, 138*b* and a second attachment component 139*a*, 139*c*, 139*d*, 139*b* at each end thereof (see FIG. 2). The support posts 114 either side of the first and second vertical end rails 127*a*, 127*b* also form part of the reinforcing arrangement.

Figure 2:
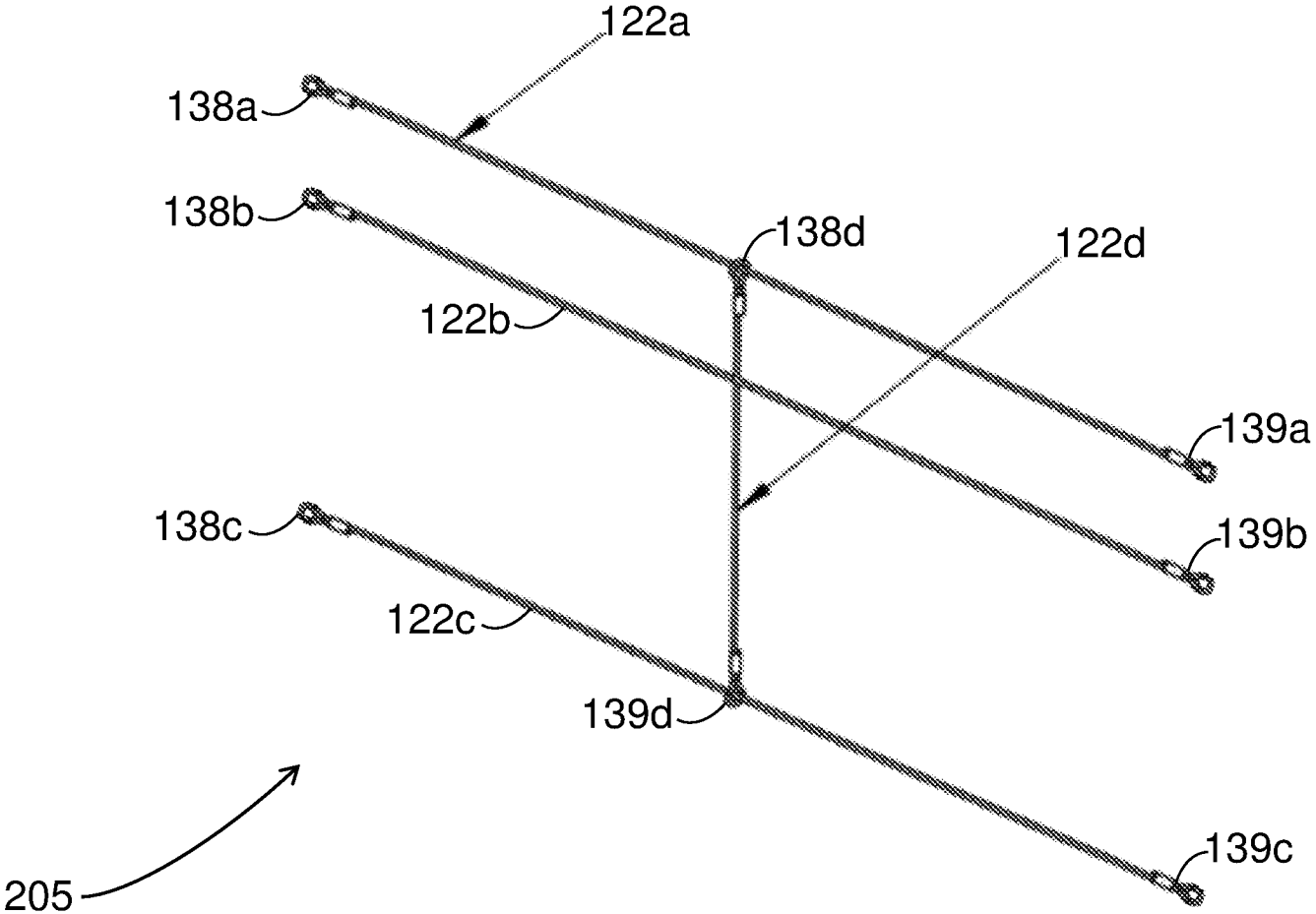
FIG. 2 is a perspective view of part of a reinforcing arrangement installed in the vehicle security barrier system of FIG. 1.

Referring again to the reinforcing arrangement and to the elements 205 shown in FIG. 2, it can be seen that the first and second attachment components 138*a*, 138*b*, 138*c*, 138*d*, 139*a*, 139*b*, 139*c*, 139*d* are the same on each end of each cable 122*a*, 122*b*, 122*c*, 122*b*. In other embodiments, the first and second attachment components 138*a*, 138*b*, 138*c*, 138*d*, 139*a*, 139*b*, 139*c*, 139*d* may differ from that shown; and/or may be different at a first end compared to a second end of a cable; and/or may differ from cable to cable. Optionally, as shown, the first and second attachment components 138*a*, 138*b*, 138*c*, 138*d*, 139*a*, 139*b*, 139*c*, 139*d* comprise loops formed by folding the end of the cable back on itself and securing the cut end alongside the main length of cable using a ferrule. Other attachment components may be suitable, for example, a twisted, looped end formed by folding the end of the cable back on itself and twisting or weaving the folded ends into the twisted form of the main length of cable.

Referring again to FIG. 1, in "off-the-shelf" panels used as pedestrian guard rails, the rectangular and tubular main frame is a closed and welded structure. However, in the present vehicle security barrier systems 200 that are optionally developed using "off-the shelf" pedestrian guard rail panels, access apertures are created for accessing the internal tubular structure and for installing therein, elements 205 of the reinforcing arrangement (see FIG. 2). In other embodiments wherein bespoke, purpose formed panels are used, such access apertures may be integrally formed when forming the panel itself, or may even not be required depending upon the method by which the panel is reinforced.

Whilst not necessarily visible in FIG. 1 of the accompanying illustrations, access apertures are optionally formed by laser cutting, and may be provided:

- on an outer face of the first vertical end rail 127*a* proximate to a first end of the first transverse rail member 124*a;*
- on an outer face of the first vertical end rail 127*a* proximate to a first end of the second transverse rail member 124*c;*
- on an outer face of the first vertical end rail 127*a* proximate to a first end of the fourth transverse rail member 124*b;*
- on an outer face of the second vertical end rail 127*b* proximate to a second end of the first transverse rail member 124*a;*
- on an outer face of the second vertical end rail 127*b* proximate to a second end of the second transverse rail member 124*c;*
- on an outer face of the second vertical end rail 127*b* proximate to a second end of the fourth transverse rail member 124*b;*
- on an outer face of the middle of the first transverse rail member 124*a*, proximate to a first end of the third (vertical) rail member 126; and
- on an outer face of the middle of the second transverse rail member 124*c*, proximate to a second end of the third rail (vertical) member 126.

Referring to FIGS. 1 and 2, installing the reinforcing arrangement comprises:

ix) threading the third cable 122*d* into the middle aperture in either the first or second transverse rail member 122*a*, 122*c* and through the third (vertical) rail member 126 and toward the middle access aperture in the other of the first or second transverse rail member 122*a*, 122*c*, such that the first and second attachment components can be coupled to the first cable and to the second cable;

x) threading the first cable 122*a* into the access aperture on the outer surface of the first vertical end rail 127*a*, through the first transverse rail member 124*a*, through the first attachment means 138*d* of the third cable 122*d* (thus coupling the first cable 122*a* to the first attachment component of the third cable 122*d*), further through the first transverse rail member 122*a*, and out of the access aperture on the outer surface of the second vertical end rail 127*b;* xi) locating the first attachment component 138*a* of the first cable 122*a* internally of the first support member 114 (see below);

xii) locating the second attachment component 139*a* of the first cable 122*a* internally of the second support member 114 (see below);

xiii) threading the second cable 122*c* into the appropriate access aperture on the outer surface of the first vertical end rail 127*a*, through the second transverse rail member 124*c* and coupling the second cable 122*c* to the second attachment component 139*d* of the third cable 122*d* and further threading the second cable 122*c* through the second transverse rail member 122*c*, and out of the appropriate access aperture on the outer surface of the second vertical end rail 127*b*; and xiv) locating the first attachment component 138*c* of the second cable 122*c* internally of the first support member 114 (see below);

xv) locating the second attachment component 139*c* of the second cable 122*c* internally of the second support member 114 (see below);

xvi) threading the fourth cable 122*c* into the appropriate access aperture on the outer surface of the first vertical end rail 127*a*, through the fourth transverse rail member 124*b* and past the third cable 122*d* within the third rail member 126 and further threading the fourth cable 122*b* through the remainder of the fourth transverse rail member 122*b*, and out of the appropriate access aperture on the outer surface of the second vertical end rail 127*b;* xvii) locating the first attachment component 138*b* of the fourth cable 122*b* internally of the first support member 114 (see below); and xviii) locating the second attachment component 139*b* of the fourth cable 122*b* internally of the second support member 114 (see below).

Figure 3B:
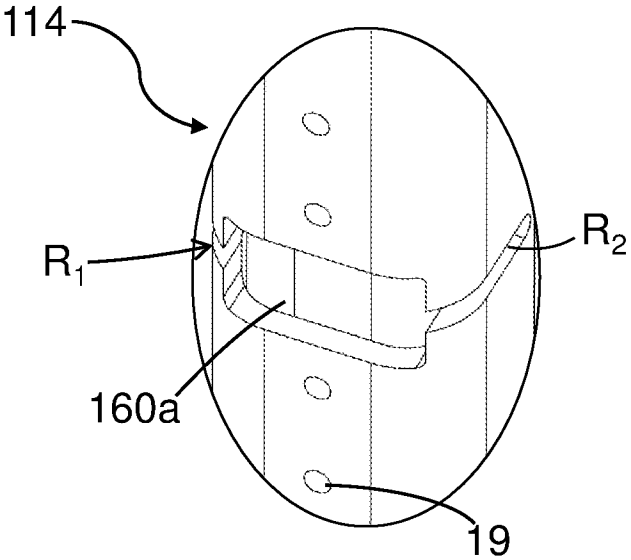
FIG. 3B is an enlarged view of a portion of the support member of FIG. 3C showing one of the access apertures for receiving a portion of the reinforcing arrangement of FIG. 2.
Figure 3C:
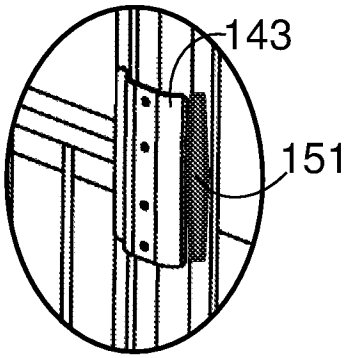
FIG. 3C is an enlarged view of a portion of the support member of FIG. 3C, showing a reinforcing cover plate attached to the support member and obscuring the access apertures from view.
Figure 3A:
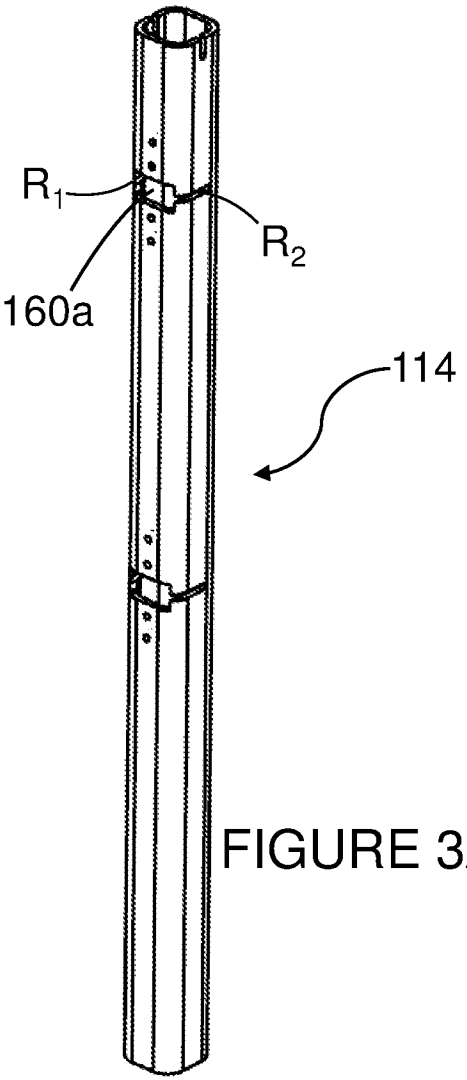
FIG. 3A is a perspective view of a support member (also referred to as "post" or "smart-post") forming part of the reinforcing arrangement of the present embodiment; the support member having a series of access apertures, each for allowing a portion of the reinforcing arrangement shown in FIG. 2 to be received within the post.
Figure 4:
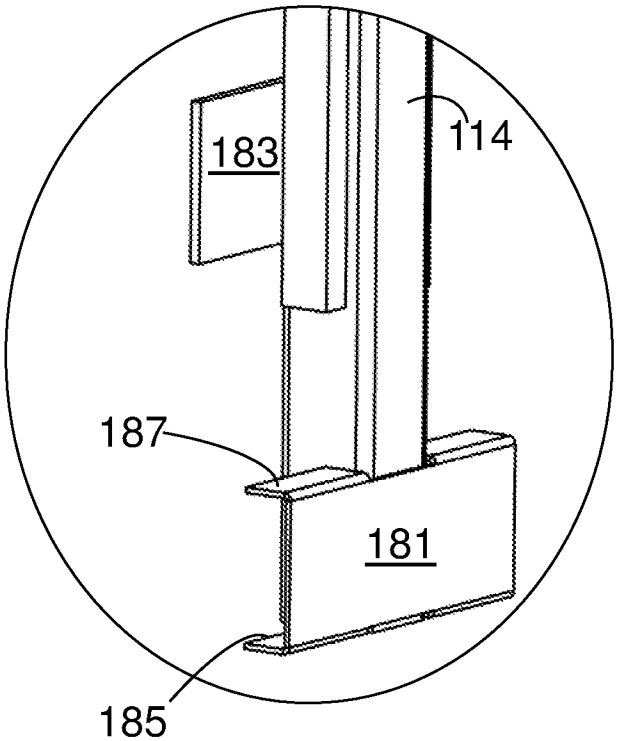
FIG. 4 is a perspective view of a bottom section of the support member used in the vehicle security barrier system of FIG. 1, showing a heel plate and a toe-plate, attached to the support member. The heel and toe plates are, in use, disposed below ground.
Figure 5:
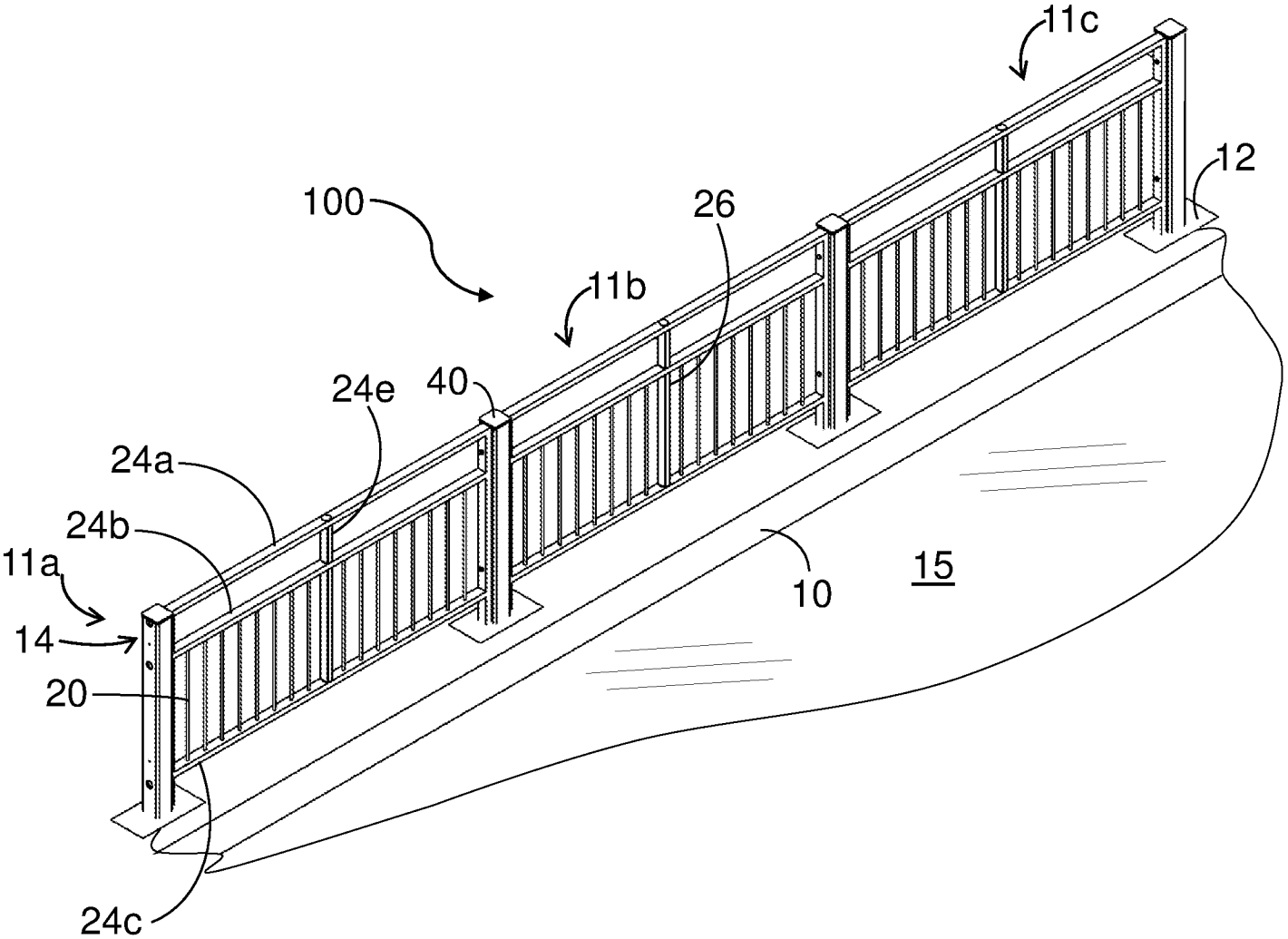
FIG. 5 is a perspective view of a section of vehicle security barrier system according to another embodiment, wherein three vehicle security barrier units (only one full unit is shown) are illustrated.
Figure 6:
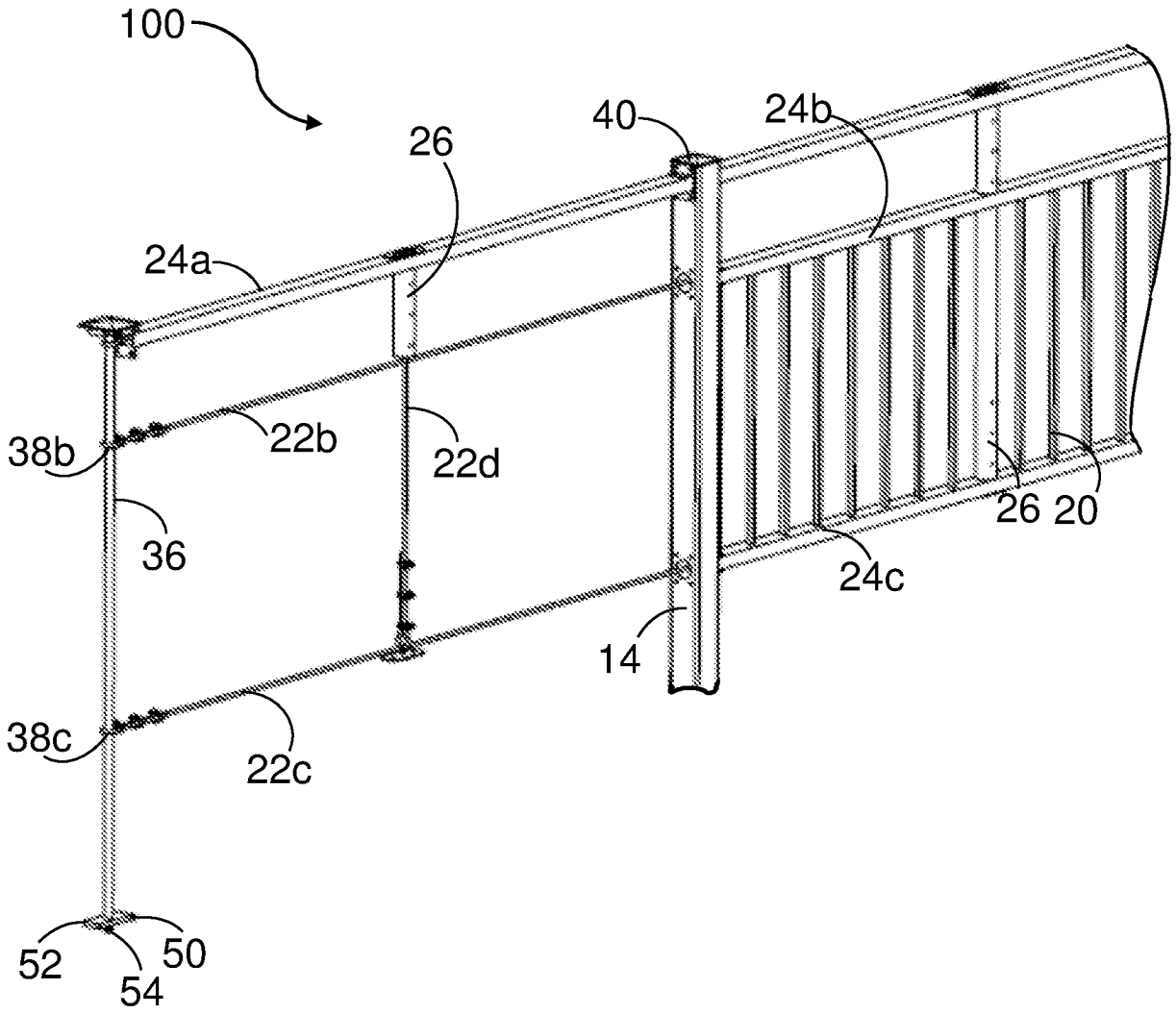
FIG. 6 is an enlarged perspective view of a section of the vehicle security barrier system of FIG. 5, wherein certain elements or components of the vehicle security barrier system have been removed or cutaway in order to illustrate at least part of a reinforcing arrangement installed in or within the vehicle security barrier system.
Figure 7:
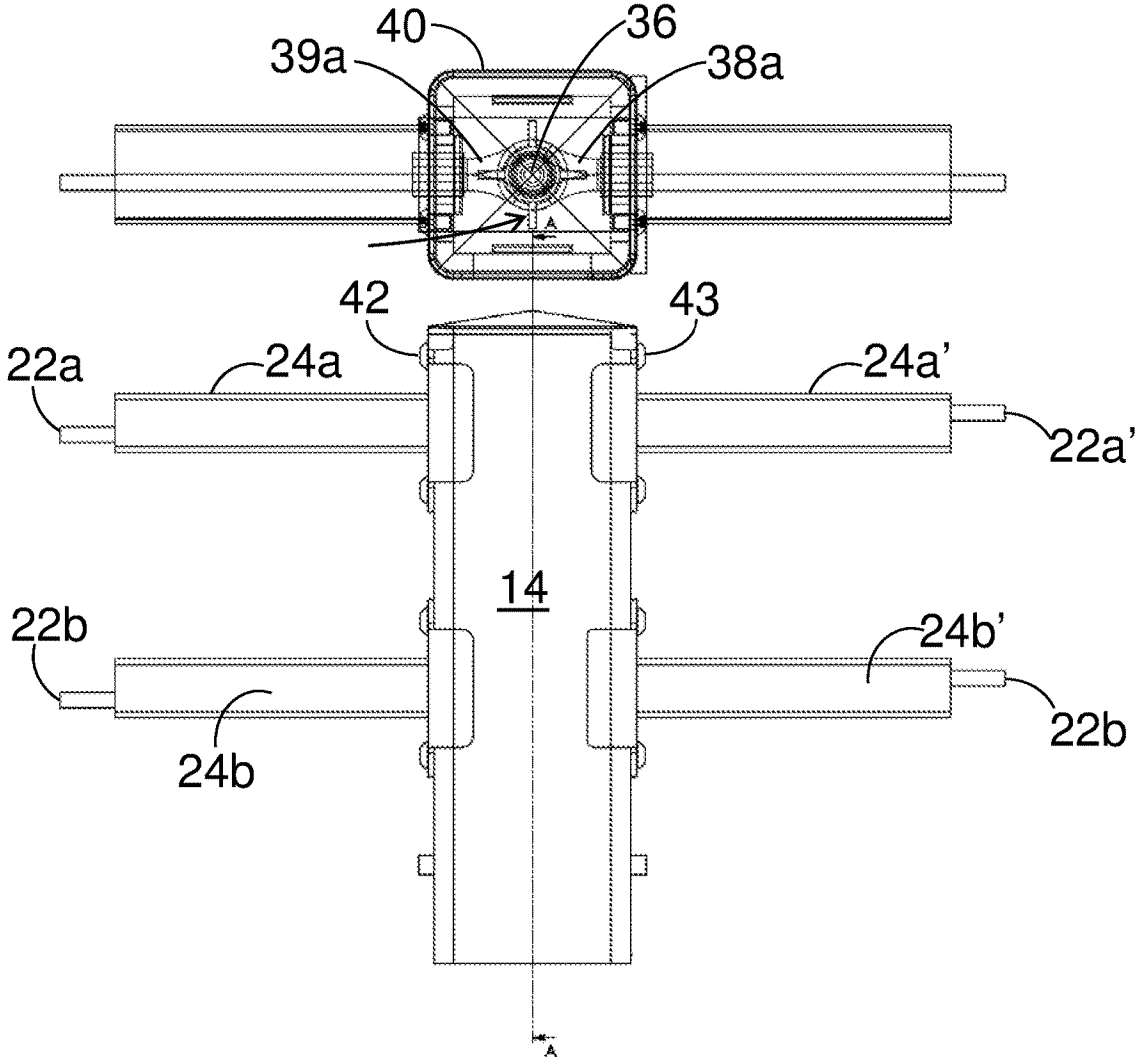
FIG. 7 is top view and a front view of a post-section of the vehicle security barrier system of FIG. 5.

Referring to FIGS. 3A to 4 collectively, unique, creative and beneficial features of the support members 114, which permit the panels of the system 200 to be both easily, quickly and accurately installed, as well as easily, quickly and accurately replaced for repair and maintenance, are shown. The posts or support elements 114 are optionally, generally identical in form to one another to enable large scale production and to alleviate any complications and mitigate against any installation errors that may otherwise occur if left and right-handed posts were formed. The posts also have a tubular form; also with a square cross-section, such that the posts 114 have four flat sides and the first and second vertical end rails 127*a*, 127*b* of the panels 111*a*, 111*b* can snugly fit and abut up against a side of the post.

Figure 8B:
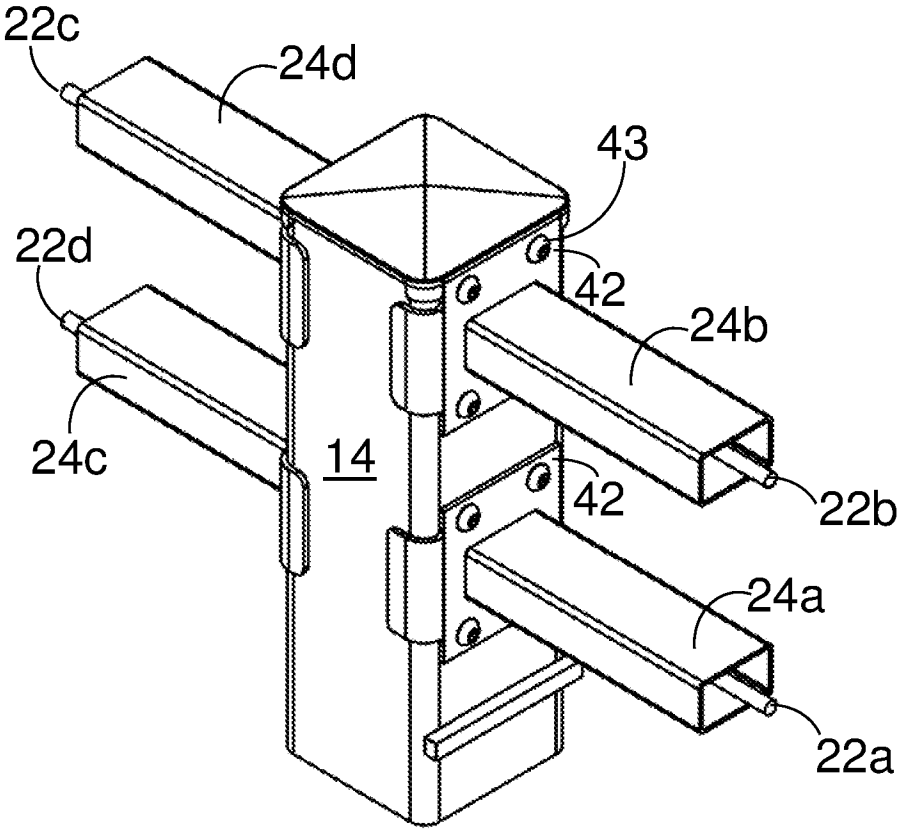
FIG. 8B is a perspective view of the post-section of FIG. 7.
Figure 8A:
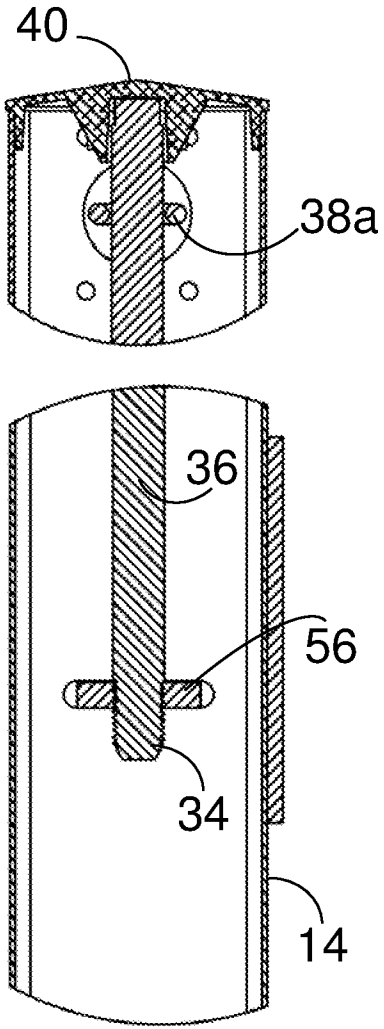
FIG. 8A is a cross-sectional view through part of a post-section of the vehicle security barrier system of FIG. 5.
Figure 9:
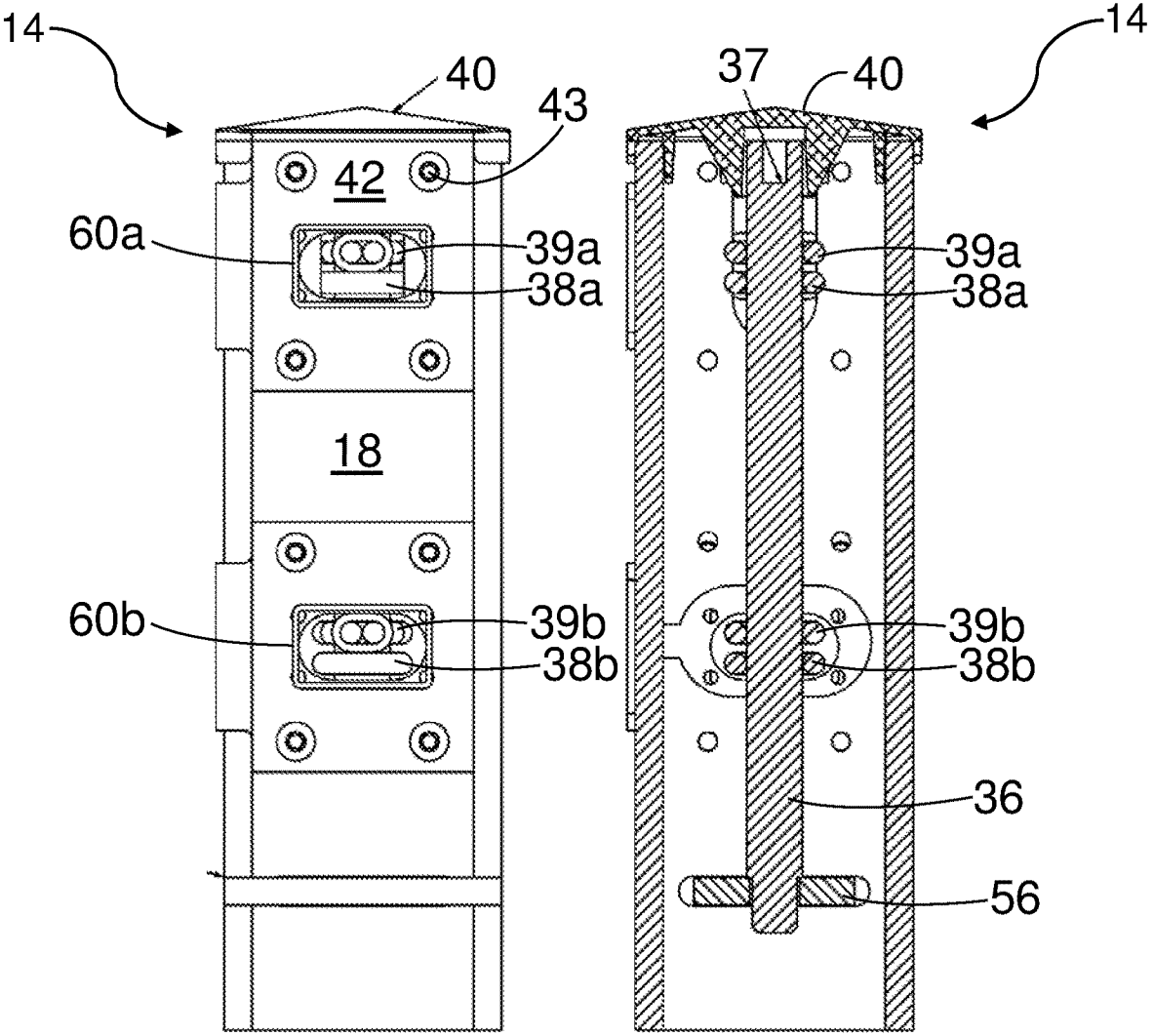
FIG. 9 is a plan view of the side of the post-section of FIGS. 7, 8A and 8B, along with a cross-sectional view of the same.

The tubular main section may have a top cap for covering an uppermost end thereof, to which a locking bar or rod may be affixed. The locking rod is not illustrated in FIGS. 1 to 4, however see FIG. 8A where a locking rod 36 of a system 100 of another illustrated embodiment of a system 100 of the disclosure is shown.

The posts 114 each comprise an anchoring foot structure at a bottom end thereof to assist in the robust, yet relatively quick, ground installation of the posts 114. The foot structure may comprise a heel plate 181 on a first, (optionally front) face of the post 114; and a toe plate 183 on a second, (optionally rear) face of the post 114.

The heel plate 181 is disposed at an elevation below the toe plate 183, such that in use, the heel plate 181 is disposed below ground level and below the level of the toe plate 183. In use, the toe plate 183 is also disposed below ground level.

The bottom end structure of the post 114 may be secured in place by concrete, and a simple "post-crete" style of quick-set concrete may be a convenient, efficient and sufficiently substantial product for securing the post 114 into the ground.

A further optional, yet beneficial feature is one or more protruding edges 185, 187 which may project from the heel plate 181, optionally in the direction toward the plane of the toe plate 183. The one or more protruding edges 185, 187 which may assist in the anchoring foot structure of the post 114 engaging into and anchoring into the material and concrete below ground in order to enhance the secure hold the post 114 has underground. This, further contributes to the strength of the system 200 and its ability to halt progression of a hostile vehicle attempting to break through the vehicle security barrier 200.

The posts 114 once securely installed into their concrete footings 112 are ready to receive the first and second ends respectively of the first and second and fourth cables 122*a*, 122*c*, 122*b*. As can be seen in FIG. 3A, the top of the post is open for having top loaded thereinto, portions of the first and second attachment components 138*a*, 139*a* of first cables 122*a* of adjacent panels 111*a*, 111*b*. Two vertically arranged slits, recesses or notches are provided, each for receiving part of a first cable 122*a*.

The post is further provided with one or more, in this arrangement two apertures 160*a*, each of which provides an opening for having placed therethrough portions of the first and second attachment components 138*c*, 139*c*, 138*b*, 139*b* of second and fourth cables 122*c*, 122*b* respectively, of adjacent panels 111*a*, 111*b*. Two transversally arranged slits, recesses or notches R1, R2 are provided in opposing sides of the post 114 (each adjacent to the side of the post 114 comprising the apertures 160*a*.

Once a post 114 has received within it the correct ends of the cables of the reinforcing arrangement, for example, once the first attachment components 138*a*, 138*c*, 138*b* of the first, second and fourth cables 122*a*, 122*c*, 122*b* are positioned within the post 114, then the locking rod (see 36 in FIG. 8A as an example) can be threaded down inside the post 114 through the attachment loops 138*a*, 138*c*, 138*b* of the first, second and fourth cables 122*a*, 122*c*, 122*b*. It can be appreciated that a two-person team may co-operate with one another to manipulate the various elements of the reinforcing arrangement into their final positions and aside from one or two steps which have to be carried out in order, some of the steps described sequentially herein may take place in a different order to that stated or may take place at the same time as the two-person team co-operates together. The top cap 140 can then be welded or secured in place. Optionally, a locking mechanism for securing the bottom end of the locking bolt into the ground may also be provided.

To secure the reinforcing cables within the system 200, a cover plate 143 (see FIG. 3C) is riveted, bolted, screwed, welded or otherwise affixed to the post 114. Beneficially, the cover plate 143 may occlude from view the aperture 160*a*, the recesses R1, R2, and the attachment components and cables 138*a*, 138*b*, 138*c*, 139*a*, 139*b*, 139*c*, 122*a*, 122*b*, 122*c*. The cover plates 143 are thick steel plates; optionally requiring four fixings to span the length of the plate 143. The cover plates 143 are considered to offer additional strength into the region of the post 114 where its structure may have been weakened slightly by the introduction of laser cut apertures 160*a* and recesses R1, R2.

A second reinforcing plate 151 is shown in FIG. 3C, and this may serve to provide further strengthening of the post 114 in the region of the recesses R1, R2. Optionally a lozenge-type shape of thick steel plate may offer an optimum amount of reinforcement. The second reinforcing plate 151 may be welded to the post 114, and the lozenge shape may facilitate a continuous and secure welded joint between the post 114 and the second reinforcing plate 151.

As can be seen in FIG. 1, the panels 111*a*, 111*b* comprise optional in-fill bars 120 and the structure provides a visibility gap between the first and third transverse rails 124*a*, 124*b*. In this way the appearance of the panels 111*a*, 111*b* if not matching, is at least very similar to the appearance of known pedestrian safety railings; and the vehicle security barriers 200 taught herein, still function as pedestrian safety railings by providing pedestrians with clear road visibility. The internal structure is however, massively different and as a result, the capability of the vehicle security barrier system 200 of the present disclosure to function as a hostile vehicle mitigation device is massively different to the capability of a mere pedestrian safety rail.

In FIGS. 6 to 9 a further embodiment of a vehicle security barrier system 100 is shown. Many features are identical in function and therefore, only the differences compared to the VSB system of FIGS. 1 to 3C are described. The panels 11*a*, 11*b* do not necessarily comprise first and second vertical end rails 127*a*, 127*b* as in the first embodiment, and sides of the posts 14 are used to complete the rectangular form of the panel. The reinforcing arrangement is the same and FIGS. 6 to 9 show again, how cables 22*a*, 22*b*, 22*c* and their attachment components 38*a*, 38*b*, 38*c* can be located within the posts to permit for replacement of individual sections of the system, for example only panel 11*a*, should maintenance be required.

It will be recognised that as used herein, directional references such as "top", "bottom", "front", "back", "end", "side", "inner", "outer", "upper" and "lower" do not necessarily limit the respective components to such orientation, but may merely serve to distinguish these components from one another.

It will be recognised that as used herein, the term "vehicle security barrier" refers to a device for hostile vehicle mitigation the purpose of which is to stop, halt or otherwise arrest the free passage of a vehicle or at least resist a vehicle impact.

It will be recognised that as used herein, the term pedestrian walkway refers to any of a "pavement", "side walk" and "footpath", and is intended to encompass any form of path provided for persons to travel along by foot.

The invention claimed is:

1. A vehicle security barrier system for hostile vehicle mitigation, the vehicle security barrier system comprising:

a panel;

a reinforcing arrangement;

a first support member; and a second support member, the panel comprising: first and second rail members, extending transversely between the first and second support members; and a third rail member extending between the first and second rail members;

the reinforcing arrangement comprising: a first cable extending through the first rail member, the first cable having first and second attachment components at respective ones of first and second ends thereof; a second cable extending through the second rail member, the second cable having first and second attachment components at respective ones of first and second ends thereof; and a third cable extending within the third rail member, the third cable having first and second attachment components at each of first and second ends thereof, the first attachment component of the third cable being coupled to the first cable extending within first rail member, and the second attachment component of the third cable being coupled to the second cable extending through the second rail member;

the first support member comprising: a tubular main section; an aperture in the tubular main section for receiving said first attachment component at the first end of the first cable; at least one recess or slit associated with said aperture; and a cover plate affixed to the first support member for adding strength proximate said aperture and/or at least one recess; and the second support member comprising: a tubular main section; an aperture in the tubular main section for receiving said second attachment component at the second end of the first cable; at least one recess or slit associated with said aperture; and a cover plate affixed to the second support member for adding strength proximate said aperture and/or at least one recess;

wherein the first attachment component comprises a loop and is coupled to a locking post of the first support member, and wherein the second attachment component comprises a loop and is coupled to a locking post of the second support member.

2. A vehicle security barrier system according to claim 1 wherein said tubular main section of the first support member and/or second support member has a top cap covering an uppermost end thereof, to which said locking post is affixed.

3. A vehicle security barrier system according to claim 1 wherein a bottom cap covers a bottommost end of the tubular main section of the first support member and/or second support member.

4. A vehicle security barrier system according to claim 3 wherein the first support member and/or second support member comprises: a heel plate; and a toe plate having a lip edge.

5. A vehicle security barrier according to claim 4 wherein the heel plate is disposed at an elevation below the toe plate, such that in use, the heel plate is disposed below ground level and below the level of a top plate; and where in use, the top plate is also disposed below ground level.

6. A vehicle security barrier system according to claim 1, wherein the first support member and the second support member each comprise: two apertures formed in the tubular main section, each of said two apertures for receiving a loop of a cable forming part of said reinforcement arrangement; and first and second cover plates positioned over the two apertures respectively and attached to the main section.

7. A vehicle security barrier system according to claim 6 wherein one or more reinforcing plates are affixed to the tubular main section and overlapping one or more portions of at least one of the at least two apertures.

8. A vehicle security barrier system according to claim 1 wherein the tubular main section of the first and/or second support member has a generally square cross-sectional shape.

9. A vehicle security barrier system according to claim 1 wherein the first and second transverse rail members are disposed in a parallel manner to one another and in a perpendicular orientation relative to the first and second support members and wherein the third rail member extends vertically between the first and second transverse rail members.

10. A vehicle security barrier system according to claim 1 wherein the first and second attachment components of the first and second cables each comprise a loop.

11. A vehicle security barrier system according to claim 10 wherein the panel further comprises:

a fourth rail member, having first and second ends, the fourth rail member extending transversely between the first and second support members and being adjoined at its first and second ends to the first and second support members respectively; wherein the reinforcing arrangement further comprises: a fourth cable extending within the fourth rail member, the fourth cable having first and second attachment components at each of first and second ends thereof, the first attachment component of the fourth cable comprising a loop and being coupled to the first support member, and the second attachment component of the fourth cable comprising a loop and being coupled to the second support member, the fourth rail member being disposed at an elevation that is above the second transverse rail member and below the first transverse rail member, such that the fourth rail member intersects the third rail member that extends vertically between the first and second transverse rail members, and such that the third cable extending within the third rail member crosses or intersects the fourth cable.

12. A vehicle security barrier system according to claim 11 wherein any one or more of the first, second, third and fourth cables comprise a twisted steel cable having a diameter of about 8 mm, about 10 mm or about 20 mm.

13. A vehicle security barrier system according to claim 12, wherein the first support member comprises two apertures formed in the tubular main section, each of said two apertures for receiving a component of a cable forming part of said reinforcement arrangement; and wherein first and second cover plates are positioned over the two apertures respectively and are attached to the tubular main section.

14. A method of forming a vehicle security barrier system according to claim 1, the method comprising installing a reinforcing arrangement, the reinforcing arrangement comprising: first, second and third cables, each comprising a first attachment component and a second attachment component at each end thereof, wherein said installing the reinforcing arrangement comprises:

i) threading the third cable through the third rail member, such that the first and second attachment components of the third cable can be coupled to the first cable and to the second cable;

ii) threading the first cable through the first transverse rail member; and coupling the first cable to the first attachment component of the third cable;

iii) affixing the first attachment component of the first cable to the first support member by passing the first attachment component through an aperture;

iv) affixing the second attachment component of the first cable to the second support member by passing the first attachment component through an aperture;

v) threading the second cable through the second transverse rail member and coupling the second cable to the second attachment component of the third cable;

vi) affixing the first attachment component of the second cable to the first support member by passing the first attachment component through an aperture; and vii) affixing the second attachment component of the second cable to the second support member by passing the first attachment component through an aperture.

15. A method of forming a vehicle security barrier system according to claim 14 further comprising the steps of affixing first and second cover plates over the apertures in the first support member; and affixing first and second cover plates over the apertures in the second support member.

16. A method of forming a vehicle security barrier system according to claim 15 wherein the locking post of the first support member and second support member each extend through the main section, the locking post sized and configured for, and being threaded through the first attachment components of the first and second cables; and second attachment components of the first and second cables respectively.

* * * * *